US005803796A

United States Patent [19]

Barton, II

[11] Patent Number: 5,803,796

[45] Date of Patent: Sep. 8, 1998

[54] MICROFINISHING MACHINE

[76] Inventor: Kenneth A. Barton, II, 1477 Haslett Rd. P.O. Box 609, Haslett, Mich. 48840

[21] Appl. No.: 769,703

[22] Filed: Dec. 18, 1996

[51] Int. Cl.[6] ..... B24B 19/12

[52] U.S. Cl. ..... 451/168; 451/173; 451/174; 451/317

[58] Field of Search ..... 451/168, 173, 451/174, 49, 62, 317, 907, 904

[56] References Cited

U.S. PATENT DOCUMENTS

| | | | |
|---|---|---|---|
| Re. 31,593 | 6/1984 | Judge, Jr. . | |
| 1,864,584 | 6/1932 | Cowdery . | |
| 1,993,543 | 3/1935 | Egger | 451/49 |
| 2,376,531 | 5/1945 | Egger . | |
| 3,302,336 | 2/1967 | Bowman . | |
| 3,722,144 | 3/1973 | Rickrode et al. . | |
| 4,501,092 | 2/1985 | Archibald . | |
| 4,694,613 | 9/1987 | Bernhard . | |
| 4,747,234 | 5/1988 | Weber . | |
| 4,907,371 | 3/1990 | Shoda . | |
| 4,993,191 | 2/1991 | Judge et al. . | |
| 5,058,325 | 10/1991 | Pineau . | |
| 5,437,125 | 8/1995 | Barton, II | 451/317 |
| 5,683,291 | 11/1997 | Humpert et al. | 451/173 |

FOREIGN PATENT DOCUMENTS

| | | | |
|---|---|---|---|
| 1548020 | 3/1990 | U.S.S.R. | 451/49 |
| 531128 | 12/1940 | United Kingdom . | |
| 549423 | 11/1942 | United Kingdom . | |

*Primary Examiner*—Robert A. Rose
*Attorney, Agent, or Firm*—Mick A. Nylander

[57] ABSTRACT

A surface polishing machine for polishing a workpiece, the machine including a body member adapted to be positioned adjacent the workpiece and having first and second pivot means spaced apart from each other, a pair of polishing arms, each pivotable on a pivot means, each arm having a first end adapted to receive a surface grinding means for finishing the workpiece and a second end, an actuating means connected to the respective second ends of the first and second polishing arms for moving the arms about the first and second pivot means from respective treatment enabling positions adjacently spaced from the workpiece to respective treatment positions wherein the surface grinding means engages the workpiece, whereby the actuating means forces the respective second ends of the first and second polishing arms away from each other thereby producing a grinding pressure at the surface grinding means of each respective first and second polishing arms, a rolling support member for pivotably supporting and horizontally transferring the surface polishing tool to predetermined positions polishing positions, a base for supporting the rolling support member, the base being movable with respect to the workpiece along and adjacent to the axis, the base including at least one guideway extending through the base and a support table for supporting the power means and the base, the support table including at least one flanged support rail configured to cooperatively mate and slidingly engage with the at least one guideway to provide linear positioning of said base.

27 Claims, 5 Drawing Sheets

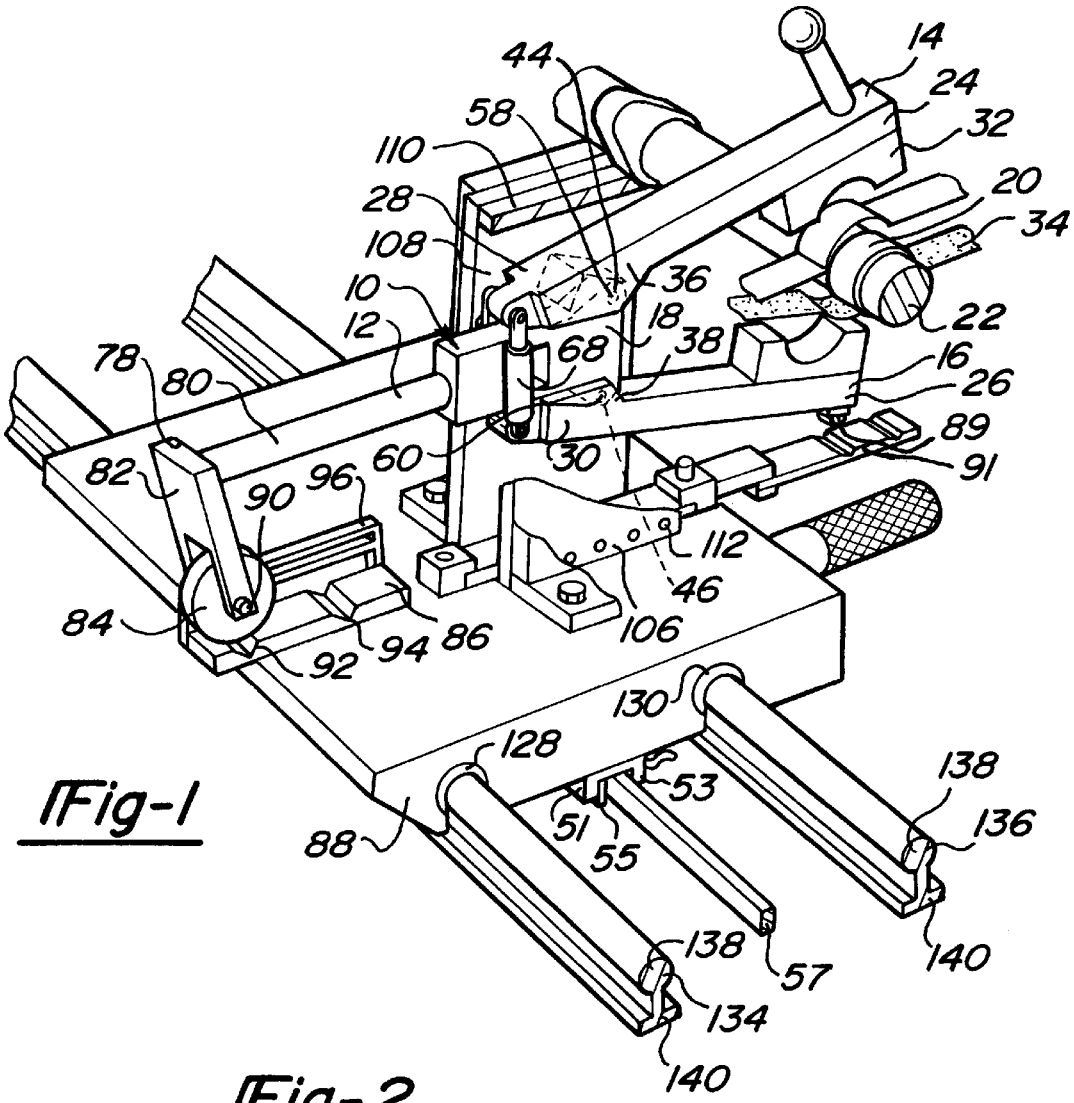
Fig-1
Fig-2
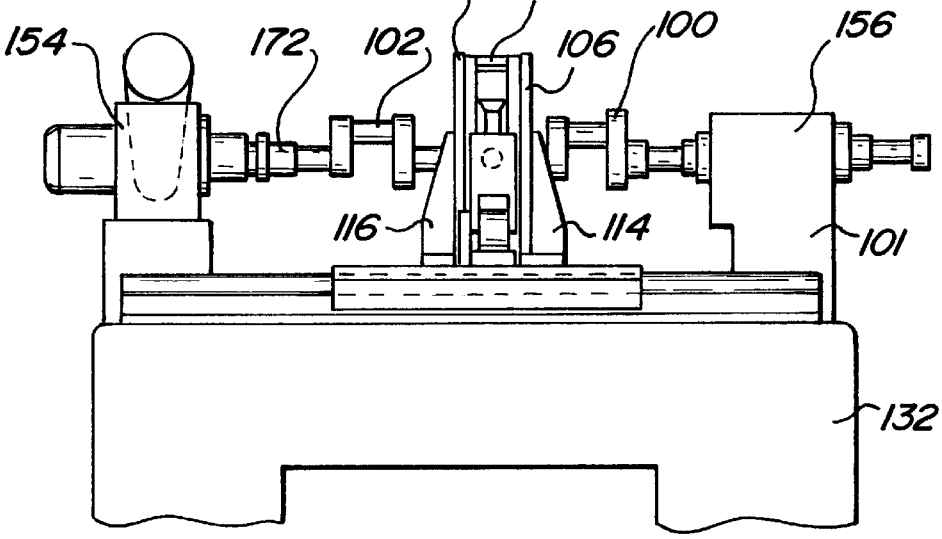

MICROFINISHING MACHINE

TECHNICAL FIELD

This invention relates generally to metal surface finishing and more particularly to an assembly for microfinishing or micropolishing metal surfaces on various machine components.

BACKGROUND OF THE INVENTION

"Microfinishing", "micropolishing", or "superfinishing", as it is known in the art, is a surface finishing process wherein a grinding means is brought to bear against a workpiece which has been previously rough ground. Microfinishing is a low velocity abrading process which generally follows rough grinding. Because microfinishing incorporates lower cutting speeds than grinding, heat and pressure variants may be minimized to provide improved size and geometry control. Those skilled in the art recognize that surface quality or roughness is measured in roughness average values ($R_a$) wherein $R_a$ is the arithmetical average deviation of minute surface irregularities from hypothetical perfect surfaces. Microfinishing can provide surface quality of approximately 1 to 10 $\mu$in. (0.025 to 0.25 $\mu$m). Bearing surfaces of crankshafts, cam shafts, power transmission shafts in similar machine components that rotate on journal bearing surfaces generally require this surface finish for satisfactory operation.

Conventional mass production microfinishing machines have the ability to finish all the bearing surfaces on a workpiece in one operation. These machines contain a plurality of abrasive tape segments which are aligned with respect to the bearing surfaces. In operation, the workpieces are rotated as the microfinishing machine causes abrasive tape segments to contact and thus finish the bearing surfaces. These large multi-abrading machines are capable of successive steps in one operation including rough grinding, grinding and microfinishing.

As is common in large scale production, failures may occur at one or more of the grinding areas or abrasive tape positions. As a result, workpieces may be produced with one or more bearing surfaces (but less than all bearing surfaces) which are not finished to the required surface quality specifications. In such cases, the grinding machine operator must then remove and scrap the defective workpiece. Because microfinishing is the final stage in surface treatment operations, i.e. after rough grinding and grinding, the scrapping of microfinished parts results in a substantial loss of both material and labor to the machinist.

Microfinishing processes are used in automotive applications in the manufacture, repair and rebuilding of internal combustion (IC) engines. Microfinishing processes are also used in the manufacture of prototype parts and low volume runs of special parts. Such engines not only require finely finished bearing surfaces for engine efficiency, but also for increased durability and longevity. In the initial manufacturing stage, crankshaft and camshaft bearing surfaces are microfinished to particular roughness specifications by previously mentioned, conventional mass production microfinishing machines.

In the repair or rebuilding stages, engine components such as crankshafts and cam shafts from faulty engines or older engines, are removed and reground to remove ten to thirty-thousandths of an inch of stock from the existing bearing surfaces. The bearing surfaces of these components are then polished or microfinished by placing the respective workpieces on a lathe and manually bringing a microfinishing material in contact with the rotating bearing surfaces. This microfinishing material is often a section of abrasive material mounted on a support correspondingly shaped to the bearing surface. It is generally recognized in the industry that these manual finishing operations are inadequate for achieving finished surfaces of standard quality and are questionable in safety and ergonomic design.

Prototype automotive, automotive repair, diesel manufacture and rebuilding operations all microfinish very low volumes of engine components with respect to standard manufacturing operations. Special purpose crankshaft finishing machines such as disclosed in U.S. Pat. No. Re. 31,593 to Judge, Jr., reissued Jun. 5, 1984, are designed for low and medium volume workpiece production. These manufacturing machines are expensive and inappropriate for very low volume workpiece production or repair. Finishing machines of the type disclosed in the Judge, Jr. patent require programming of a computer controller for each different workpiece that requires finishing.

Automotive and diesel repair and rebuilding operations reclaim and refinish workpieces from hundreds of various internal combustion engines with different designs. Programmably controlling a finishing machine to accept each individual workpiece that requires microfinishing from different internal combustion engines is uneconomical and inefficient.

SUMMARY OF THE INVENTION

The surface polishing assembly of the present invention has been developed to meet the need for a manually controlled, low volume microfinishing machine that is capable of achieving finished surfaces of consistent quality on selected surfaces of previously incorrectly finished or worn workpieces. The surface polishing assembly has the versatility to accept many various families of machine components or workpieces which require bearing surface control finishing. The present invention, for example, can accept various families of cam shafts, crank shafts, axle shafts, transmission shafts, and compressor shafts without the need for programming of control sequences.

The present invention is also uniquely capable of serving as a manufacturing repair machine for correcting bearing surfaces on machine components previously microfinished by large, high volume microfinishing machines or as a very low volume microfinishing machine for automotive service repair and rebuilding operations.

The polishing assembly includes a pair of polishing arms pivotably affixed to a polishing body and adapted to receive various surface grinding materials and tooling such backup shoes and abrasive coated tape for finishing bearing surfaces on workpieces. The polishing body is attached to a base which is movable with respect to the workpiece along the axis of rotation of the workpiece. A pair of stabilizing plates are employed to restrict the polishing arms to movement in a plane substantially perpendicular to the axis of rotation of the workpiece and are adjustably attached to the base.

In operation, according to the present invention, the polishing assembly is manually indexed, bringing the polishing arms to a position adjacent the bearing surface to be microfinished. This manual indexing affords accurate and rapid operation and also allows for the accommodation of many families of machine components. The polishing arms are supported by a support arm to provide easy manipulation by the operator. The microfinishing machine operates without the need for time-consuming and expensive preprogramming of numerical control systems needed to index and operate automotive microfinishing machines.

Accordingly, it is an object of the present invention to provide a manually controlled surface polishing repair tool that is capable of microfinishing selected surfaces of previously incorrectly or worn finished bearing surfaces on a machine component or workpieces to process and tolerance specifications equal or exceeding automatic control equipment.

Another object of the present invention is to provide a surface polishing assembly including a surface polishing tool that is capable of accepting various families of machine components or workpieces that require microfinishing of selected bearing surfaces without modification.

A further object of the present invention is to provide a surface polishing assembly capable of microfinishing selected bearing surfaces and radius or fillet surfaces on a previously machined workpiece without requiring preprogrammed computer instructions.

It is a still further object of the present invention to provide an improved surface polishing machine including a surface polishing assembly that is inexpensive to manufacture and operate in medium and low volume production microfinishing processes.

A more specific object of the present invention is to provide a surface polishing tool for attachment to a power means for rotating a workpiece about an axis in a finishing process, the workpiece having at least one process surface, the surface polishing tool comprising a body adapted to be positioned adjacent the workpiece and having first and second pivot means for supporting a pair of spaced apart polishing arms, a first polishing arm pivotable on the first pivot means, the first arm having a first end including a surface grinding means for finishing the process surface of the workpiece and a second end, a second polishing arm pivotable on the second pivot means, the second arm having a first end including a surface grinding means for finishing the process surface of the workpiece and a second end, an actuating means for moving the first and second polishing arms about the first and second pivot means from a respective treatment enabling position adjacently spaced from the workpiece to a respective treatment position wherein the surface grinding means engages the workpiece, the actuating means having a stationary end and a reciprocating end, the stationary end of the actuating means connected to the second end of the first polishing arm and the reciprocating end of the actuating means connected to the second end of the second polishing arm, whereby the actuating means forces the respective second ends of the first and second polishing arms away from each other thereby moving the first and second polishing arms about the first and second pivot means and producing a grinding pressure at the surface grinding means of each respective first and second polishing arms when the polishing arms are in the treatment position, a rolling support assembly for pivotably supporting and horizontally transferring the surface polishing tool in a first direction toward the workpiece and in a second opposite direction away from the workpiece thereby affording manual movement of the first and second polishing arms to assist in locating the first and second polishing arms in the treatment position and a sliding base affixable to the body and manually moveable linearly with respect to the workpiece along and adjacent to the axis thereby allowing the polishing arms to be located with respect to the process surface on the workpiece and allowing the first and second polishing arms to be manually oscillated along a predetermined length of the process surface during the finishing process.

Yet another object of the present invention is to clamp the polishing assembly in position and provide an oscillation of the headstock or tailstock to obtain the necessary oscillatory movement.

Another more specific object of the present invention is to provide an improved surface polishing machine having a rolling support assembly comprising an elongated support arm having a first end and a second end, the first end affixed to the body, a fork member connected to the second end of the elongated support arm, a rolling wheel member attached to the fork member and a track for supporting the wheel member, the track defining at least one detent for retaining the wheel member in a stationary position.

The above objects and other objects, features and advantages of the present invention are readily apparent from the following detailed description of the best mode for carrying out the invention to be taken in connection with the accompanying drawings.

BRIEF DESCRIPTION OF THE DRAWINGS

FIG. 1 is a fragmentary perspective view of the surface polishing tool of the present invention, partly broken away to show the operation of a polishing arm;

FIG. 2 is a side view of the surface polishing tool of the present invention, including a head stock and tail stock for rotating a workpiece;

DETAILED DESCRIPTION OF THE INVENTION

Figure 3:
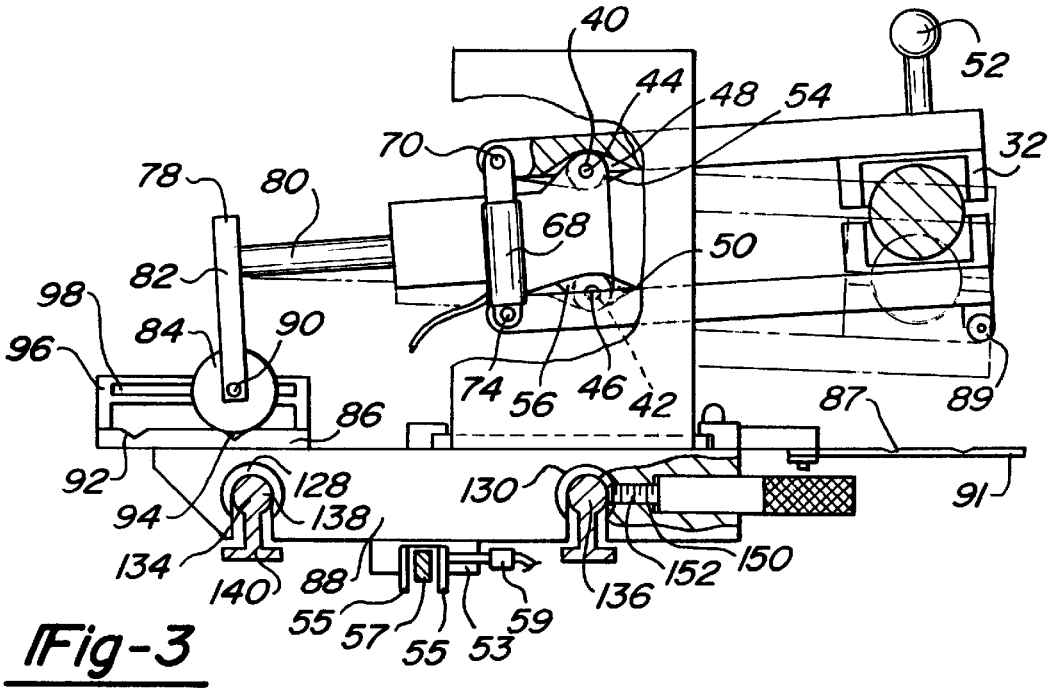
FIG. 3 is a fragmentary, partially sectioned side view of the polishing tool of the present invention and broken away to show the polishing tool in a treatment position (solid line) and in a pivoted position (phantom line) in response to rotation of a workpiece being treated.

With reference to FIG. 1, a surface polishing tool is shown generally designated by reference numeral 10. Polishing tool 10 is shown affixed to a polishing tool assembly 12. The polishing tool 10 includes a first polishing arm 14 and a second polishing arm 16, which are both pivotally connected to the polishing tool body 18. The polishing arms 14 and 16 are shown in FIG. 1 in a treatment enabling position located adjacent the bearing or process surface 20 of an automotive cam shaft 22. The automotive camshaft 22 is a representative example or a workpiece for which the surface polishing 10 is designed to accommodate.

Polishing arms 14 and 16 have first ends 24 and 26 adapted to be pivotably connected to the polishing body 18 which are constructed to accept various families of grinding means depending on the workpiece and the extent of surface finishing required. Polishing arms 14 and 16 also have second ends 28 and 30. Various grindsecond ends 28 e attached to the second ends 28 and 30 of the polishing arms 14 and 16 by any suitable fastening means. FIG. 1 shows one example of a grinding means, an abrasive-coated tape grinding system using tape back-up shoes 32 and coated abrasive tape 34. Common abrasive tape feed and take-up mechanisms are not shown, but are known in the art. Other grinding materials include honing stones using diamond, carborundum, garnet, cubic boron nitride and other like substances.

Referring now to FIGS. 1 and 3, there is shown a pair of abrasive-coated tape back-up shoes 32 adapted to receive the bearing surface 20 of a workpiece such as cam shaft 22. Abrasive-coated tape 34 is shown adjacent tape back-up shoes 32 to further illustrate the relative positions of back-up shoes 32, abrasive-coated tape 34 and bearing surface 20 during operation of the polishing assembly. Disposed between first ends 24 and 26 and second ends 28 and 30 of top and bottom polishing arms 14 and 16 are identical pairs of connecting members 36 and 38 which extend from respective arms 14 and 16. Connecting members 36 and 38 have throughbores 40 and 42, respectively, which accept pivot pins 44 and 46, respectively.

Polishing arms 14 and 16 have hollowed recesses 48 and 50 disposed between the pairs of connecting members 36 and 38. Upper polishing arm 14 has a handle 52 for bringing upper polishing arm 14 and lower polishing arm 16 together.

Still referring to FIGS. 1 and 3, polishing tool body 18 is shown having a pair of extending sections 54 and 56 which have respective throughbores 58 and 60 disposed thereon. The connecting members of the polishing arms are adapted to cooperate with the extending sections of the tool body. Throughbores 40 and 42 are of the same diameter as the throughbores 58 and 60 of the polishing arms to allow pivot pins 44 and 46 to be located inside the throughbores and the polishing arm bores.

The polishing arms 14 and 16 are thus pivotably connected to the polishing tool body 18 by placing the connecting members 36 and 38 of polishing arms on the extending sections 54 and 56. Recesses 48 and 50 for receiving the extending sections 54 and 56. Pivot pins 44 and 46 are press fit inside the aligned throughbores 40 and 58 and 42 and 60 and thus connect the polishing arms to the 14 and 16 to the body 18 and work as pivoting members for the polishing arms.

Figure 4:
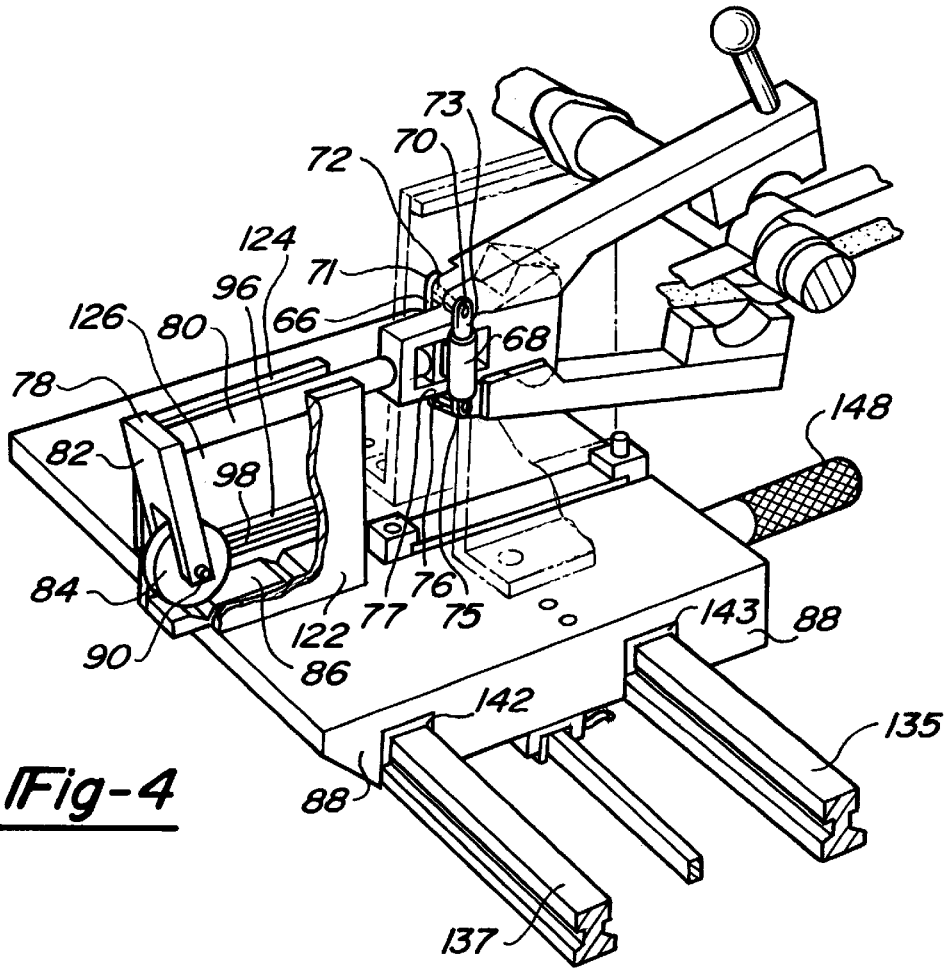
FIG. 4 is a fragmentary view of an alternative embodiment of the polishing tool of the present invention showing the rolling support member disposed between stabilizing plates.

Referring to FIGS. 1, 3 and 4, second end 28 of the first polishing arm and second end 30 of the second polishing arm 16 are shown connected to a respective pair of fluid biasing cylinders 66 and 68. The fluid biasing cylinders 66 and 68 are connected at one end to the first polishing arm 14 by a pivot pin 70. The pivot pin 70 extends through the first reciprocating ends 71, 73 of the fluid biasing cylinders 66 and 68 and through a bore 72 (not shown in detail) in the first polishing arm 14. The fluid biasing cylinders 66 and 68 are connected at an opposite end to the second polishing arm 16 by a pivot pin 74. The pivot pin 74 extends through the second stationary ends 75 and 77 of the fluid biasing cylinders 66 and 68 and through a bore 76 (shown in phantom) in the first polishing arm. In this manner the pair of fluid biasing cylinders are pivotably connected to the first and second polishing arms 14 and 16 as shown in FIGS. 1 and 3.

Each fluid biasing cylinder 66 and 68 is attached to a controller (not shown) which provides control commands to a fluid compressing means (not shown) for controlling the amount and duration of pressure required to activate and operate the fluid biasing cylinders 66 and 68. In this manner, as the fluid biasing cylinders 66 and 68 are operated, the reciprocating ends 71 and 73 of the cylinders move and in turn move the first and second polishing arms 14 and 16 from a treatment enabling position as shown in FIG. 1 to a treatment position as shown in FIG. 3.

Compressive contact between the grinding means as represented by the back-up shoes 32 contained on the polishing arms 14 and 16 and the workpiece surface as the workpiece is being rotated about its longitudinal axis creates the microfinishing action that finishes the process surface 20 of the workpiece. FIG. 3 shows a polishing assembly of the present invention with one surface polishing tool 10 affixed. Surface polishing tool 10 is pivotally and rollingly supported upon polishing assembly 12 by a rolling support assembly 78. Rolling support assembly 78 is comprised of an elongated support arm 80, a fork member 82 and a rolling wheel 84.

A track 86 is shown in FIGS. 1, 3 and 4 and is affixed to sliding base 88. The track 86 includes a detents 92 and 94 which assist in linearly positioning the surface polishing tool 10. Specifically, the track 86 is provided for the rolling wheel 84 to travel over and make contact with. The detents 92 and 94 are designed to provide a means for locating the rolling wheel 84 in a stationary position. As shown in FIGS. 1 and 3, the rolling wheel 84 rolls into either the detent 92 as in FIG. 1 or detent 94 as in FIG. 3. The rolling wheel is not permanently retained in the detent but sufficient force is required to move the rolling wheel 84 out of the respective detent such that the surface polishing tool is sufficiently located in a stationary position in relation to camshaft 22. This temporary stationary position is useful for manual operation of the polishing tool 10. The present invention includes provision of any number of detents allowing the track 86 to provide for many different predetermined stationary positions of the polishing tool 10. These positions are determined by the type and size of workpiece to be finished.

An axle track 96 retains axle 90 of rolling wheel 84 and provides for a controlled movement of the surface polishing tool 10 in a lateral direction toward the cam shaft 22. The axle track 96 is affixed to the sliding base 88 and directly adjacent the track 86. The axle track includes a railway 98 which is slightly larger in width to accommodate the movement of the axle 90 in a lateral direction along the railway 98 to and from the camshaft 22. This width must also be greater than the axle diameter to such an extent as to allow the minimal movement of the axle 90 in a vertical direction to accommodate placement of the rolling wheel 84 in the detents 92 and 94.

Still referring to FIG. 1, 3 and 4 rolling support assembly 78 operates as a universal support means for pivotably supporting the surface polishing tool 10 and further allowing for manual movements of the polishing tool in a direction toward the camshaft 22 and away from the camshaft 22. This movement or manual locating is important when microfinishing crank shaft pin surfaces. As shown in FIG. 2, a crank shaft 100 includes a plurality of cylindrical pin bearing surfaces 102 which must be correctly microfinished for correct operation.

For adequate microfinishing of pin bearing surfaces the entire polishing tool 10 must be movable with respect to the throw of the crank shaft pin bearings. This flexibility is necessary because the bearing surfaces of the pin bearings are positioned eccentrically with respect to the center of rotation of the crankshaft. As shown in FIG. 3, the polishing tool 10 can pivot vertically corresponding to the orbit of most crank shafts. The pivotal connection between the rolling wheel 84 and fork member 82 at the axle 90, allows for surface polishing tool 10 to orbit with conventional pin bearing surfaces located on most crank shafts.

As shown in FIGS. 1 and 3, a pair of stabilizing plates 106 are located directly adjacent the surface polishing tool 10. Stabilizing plates 106 stabilize the surface polishing tool 10 against movement during the finishing operation. Stabilizing plates 106 are positioned adjacent the surface polishing tool 10 with a minimum running clearance between surface polishing tool 10 and the inner walls 108 of the stabilizing plates. This minimum running clearance is achieved by locating the stabilizing plates adjacent the surface polishing tool to a point where sliding contact is made between the surface polishing tool and the stabilizing plates. Spacers 110 are disposed between stabilizing plates 106 to allow for stabilizing pressure to be uniformly applied along the stabilizing plates. The stabilizing plates 106 are affixable to spacers 110 by fastening screws 112.

FIG. 2 shows an alternative embodiment of the present invention with adjustable clamping fixtures 114 and 116 located directly adjacent the stabilizing plates. These clamping fixtures may be utilized to provide additional lateral support during the microfinishing process.

FIG. 4 shows an alternative embodiment of the present invention. A pair of smaller stabilizing plates 122 and 124 are shown disposed adjacent the rolling support assembly 78. The stabilizing plates 122 and 124 are designed to operate in substantially the same manner as stabilizing plates 106. The stabilizing plates 122 and 124 are located adjacent the rolling support assembly with a minimum running clearance between the rolling support assembly 78 and the inner walls 126 of the stabilizing plates 122 and 124. This minimum running clearance is achieved by locating the stabilizing plates 122 and 124 adjacent the rolling support assembly 78 to a point where sliding contact is made between the rolling support assembly 78 and the stabilizing plate inner surface 126.

Referring to now FIGS. 1, 2 and 3, sliding base 88 includes a pair of guideways 128 and 130 which extend through the base 88 from one side to the other. The support table 132 includes affixed thereon a pair of extending flanged support rails 134 and 136. The flanged support rails are configured to cooperatively mate and slidingly engage the respective guideways 128 and 130. The flanged support rail 134 and 136 shown in FIG. 1 including a first portion 138 which is generally circular in cross section and a second portion 140 which is generally rectangular in cross section connected by another rectangular portion to form the final guideway cross sectional shape. In this manner, linear positioning of the sliding base 88 and in turn the polishing assembly 10 along the axis of rotation of the workpiece is accomplished. This guideway 128 and flanged support rail 134 system of the present invention is an improvement of previous designs. The present guideway 128 and flanged support rail 134 system provides greater weight support capacity than the previous design and affords the ability for acceptance of larger polishing assemblies for larger finishing application while still affording ease of manual operation by a single operator. The guideways 128 and 130 are manufactured from a hardened ground steel and the guiderails 134 and 136 from steel or aluminum.

Referring now to FIG. 4, there is shown an alternative embodiment of the present invention utilizing a pair of flanged support rails 135 and 137. The rails 135 and 137 have a generally "I" shaped cross section. The sliding base 88 includes a pair of guideways 142 and 143 which extend through the base from one side to the other. The flanged support rails 135 and 137 are configured to cooperatively mate and slidingly engage the respective guideways 142 and 143. The different shaped guideway provides different load bearing characteristics such as load capacity, flex dimensions and length of travel.

A handle 148 is affixed to sliding base 88 to aid in sliding the polishing assembly 12 along guiderails 135 and 137. The mobility of polishing assembly 12 is integral to the operation of the polishing assembly. When only one surface polishing tool 10 is being utilized on the polishing assembly 12, successive bearing surfaces can be microfinished on one workpiece by simply indexing the polishing assembly along the axis of the workpiece and finishing a new surface each time. Polishing assembly 12 can be adapted to be affixed to any lathe type rotational grinding machine which is capable of affording lateral movement of the base.

In addition, handle 148 includes a threaded portion 150 that extends into tapped bore 152 which extends into contact with guiderail 136 as shown in FIG. 3. This handle 148 may be used as a locking and locating means for securing polishing assembly 12 in one location along slide rails 134 and 136. Handle 148 can be rotated to a position wherein threaded portion 150 contacts slide rail 136 and acts as a set screw in securing the polishing assembly in one location. This locking means is particularly useful for microfinishing a series of machine components wherein a particular bearing surface along the length of a machine component is out of specification in a number of machine components.

Handle 148 is also utilized when an operator wishes to induce an oscillating lateral movement in the polishing assembly. This lateral oscillating movement is used by the operator to control the resulting surface tool pattern that is created on the bearing surface being finished by the minute irregularities in the grinding means being used. A handle 148 is also used to move the polishing tool assembly laterally along the workpiece when the surface to be finished has a greater width than the grinding means.

Also shown in FIGS. 1 and 3 is a caliper brake system 51 or brake means for retaining the sliding base 88 in any position along the axis of the camshaft 22. The caliper brake 51 includes a caliper 53 affixed to the underside of sliding base 88. A pair of brake shoes 55 are located directly adjacent the caliper 53. An extending rail 57 is shown below sliding base 88. The extending rail 57 is affixed to the support table 132. A fluid biasing cylinder 59 is shown in FIG. 3 and is also affixed to the sliding base 88. The fluid biasing cylinder is designed to move one of the pair of brake shoes 55 into engagement with the rail 57 and retain the sliding base 88 is a stationary position during a finishing operation. A force of 400 pounds per square inch applied to the brake shoe 55 by the fluid biasing cylinder will sufficiently maintain the sliding base 88 in a stationary position during a finishing operation. This braking system may be used in addition to or independently of the handle 148 as a locking means. It is contemplated that the caliper brake 51 may be used as a substitute for the handle 148 because the caliper brake 51 provides an improved and more consistent braking force and more stability to the entire polishing assembly 12. This improved braking provides a better retention of the sliding base 88 along the axis of rotation of the workpiece during finishing operation.

A polishing arm support brace 91 is also affixed to sliding base 88. The support brace 91 supports the second polishing arm 16 when the first and second polishing arms 16 and 18 are being transferred from the treatment position to the treatment enabling position and vice versa. The polishing arm support brace 91 may include a detent 87 for locating the polishing assembly in a predetermined position. This position may correspond to a stationary position wherein the polishing arms are fully retracted to provide clearance for the linear positioning of the polishing arms 14 and 16. Polishing arm support brace 91 is useful in assisting the operator in manually moving larger polishing assemblies as some application such as large crankshaft applications require large polishing assembly that may be slightly difficult to move from the treatment position to the treatment enabling position and vice versa. In addition, a wheel 89 is rollingly attached to the second polishing arm 16 to roll along the support brace 87. This also assists the operator in manually positioning the polishing tool in relation to the workpiece.

The surface polishing machine 101 of the present invention as shown in FIG. 2, includes a head stock 154 and a tail stock 156 which together cooperate to rotate a machine component or workpiece such as a crankshaft 100 about its central axis of rotation. To microfinish the crank shaft shown in FIG. 2, the fluid biasing cylinders must be operated to provide a grinding pressure at the tape backup shoes 32. The operator of the machine regulates the pressure of the fluid biasing cylinders 66 and 68 until the requisite amount of pressure is supplied upon tape back up shoes and abrasive-coated tape 34 positioned between the polishing arms 14 and 16.

This amount of grinding pressure will vary according to different polishing surface diameters, widths of the bearing on the machine component and the desired surface finish. The speed that the workpiece is being rotated by the head stock and the duration the grinding means contacts the bearing surface also effects the roughness average values achieved on the bearing surface. Using a common abrasive tape grinding means with a roughness rating of 20 $\mu$m, and rotating the workpiece at 100 rpms, a pressure of approximately 100 psi for 15 seconds induces a roughness value of approximately 15 $R_a$.

The surface polishing assembly according to the present invention, as stated earlier, can be used in large scale manufacturing processes in the industry to recover workpieces scrapped at the microfinishing stage. This is accomplished by removing the scrapped workpiece from the microfinishing machine after an out of specification or incorrect bearing surface has been identified and installing it within the surface polishing assembly of the present invention.

The machine operator may then microfinish the particular bearing surface to the required specification, and thus reclaim the workpiece from scrap. As is known in the industry, machine components that are at the microfinishing stage represent the highest economic investment in the manufacturing process and it is thus very desirable to reclaim the workpiece at these late stages. The surface finishing assembly of the present invention is able to achieve standard surface finishes on a consistent basis, with consistent quality, and are able to achieve microfinishing levels suitable for modern internal combustion engine components.

Automotive repair and rebuild operations, as stated previously, often remove machine components from engines and microfinish bearing surfaces contained on those components. The surface polishing assembly of the present invention can be utilized to microfinish these various components with a degree of standardization that is higher than prior art procedures. In addition, the surface polishing assembly is configured to accept machine components from many different internal combustion engines. The surface polishing assembly can thus accept crankshafts and camshafts from single cylinder, to multiple cylinder engines without significant modifications.

It can be seen from the above disclosure, that the surface polishing assembly of the present invention is flexible enough to accommodate many various workpieces and can also surface finish many different surfaces on a particular workpiece. The ability to accept many different machine components and also to finish many different surfaces along the component without having to program automatic computer sequences makes the present invention economically desirable as compared to other large, dedicated microfinishing machines known in the industry.

Figure 5:
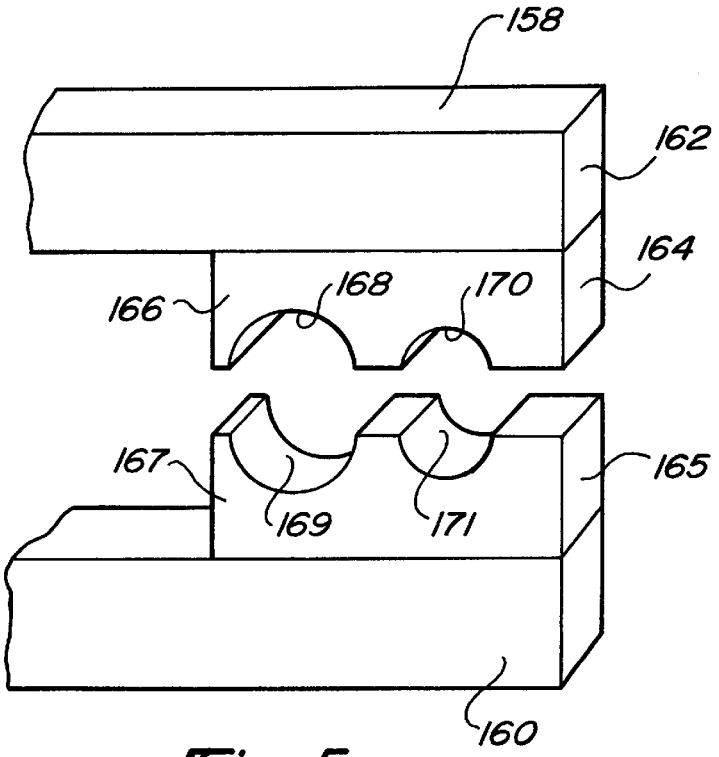
FIG. 5 is a perspective view of the surface polishing tool of the present invention, including an alternative back up shoe.

Referring now to FIG. 5, there is shown a polishing arm 158 and a polishing arm 160 which is operable in the same manner as the polishing arms discussed above. Polishing arm 158 includes a first end 162 adapted to receive a combination surface grinding means 164 for finishing a workpiece process surface. More specifically, the combination surface grinding means 164 comprises a back-up shoe 166 having a first contact surface 168 cooperatively shaped to finish a first specific process surface of a workpiece and a second contact surface 170 cooperatively shaped to finish a second specific process surface of a workpiece. Polishing arm 160 includes a cooperatively shaped combination surface grinding means 165 for finishing the workpiece process surface. The combination surface grinding means 165 comprises a back-up shoe 167 having a first contact surface 169 cooperatively shaped to finish the first specific process surface of the workpiece and a second contact surface 171 cooperatively shaped to finish the second specific process surface of the workpiece.

As shown in FIG. 5, the first and second contact surfaces are of different sizes to accommodate process surfaces of different diameters. For example, referring to the crankshaft 100 depicted in FIG. 2, there is shown a pin bearing surface 102 which is one type of process surface to be finished. This pin bearing surface 102 has a specific diameter. Main bearing surface 172, also shown in FIG. 2, is another similar type of process surface to be finished. Main bearing surface 172 has a larger diameter than pin bearing surface 102. According to the present invention, through the use of the polishing arms 158 and 160 of the embodiment shown in FIG. 5, an operator may finish all the pin bearing surfaces 102 of a crankshaft and also finish the main bearing surfaces 172 without having to stop and change the back up shoe set-up. Specifically, no time is lost in setting up the machine with different back up shoes that will accommodate the different diameters of different process surfaces.

Figure 6:
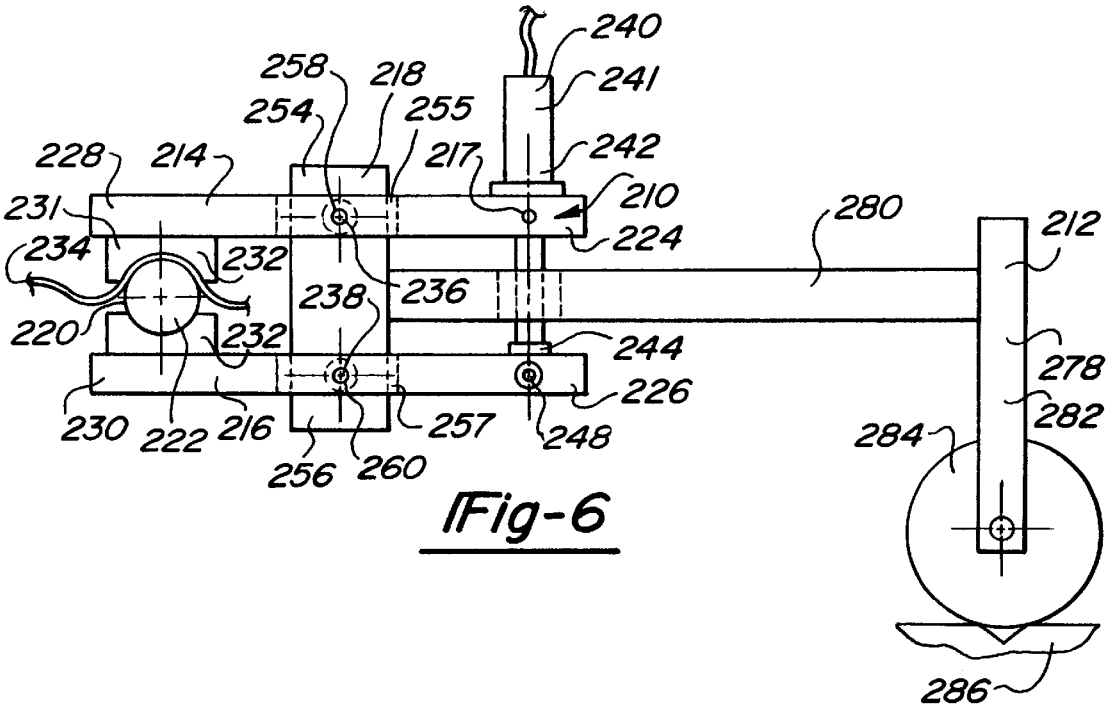
FIG. 6 is a side view of an alternative surface polishing tool of the present invention.
Figure 7:
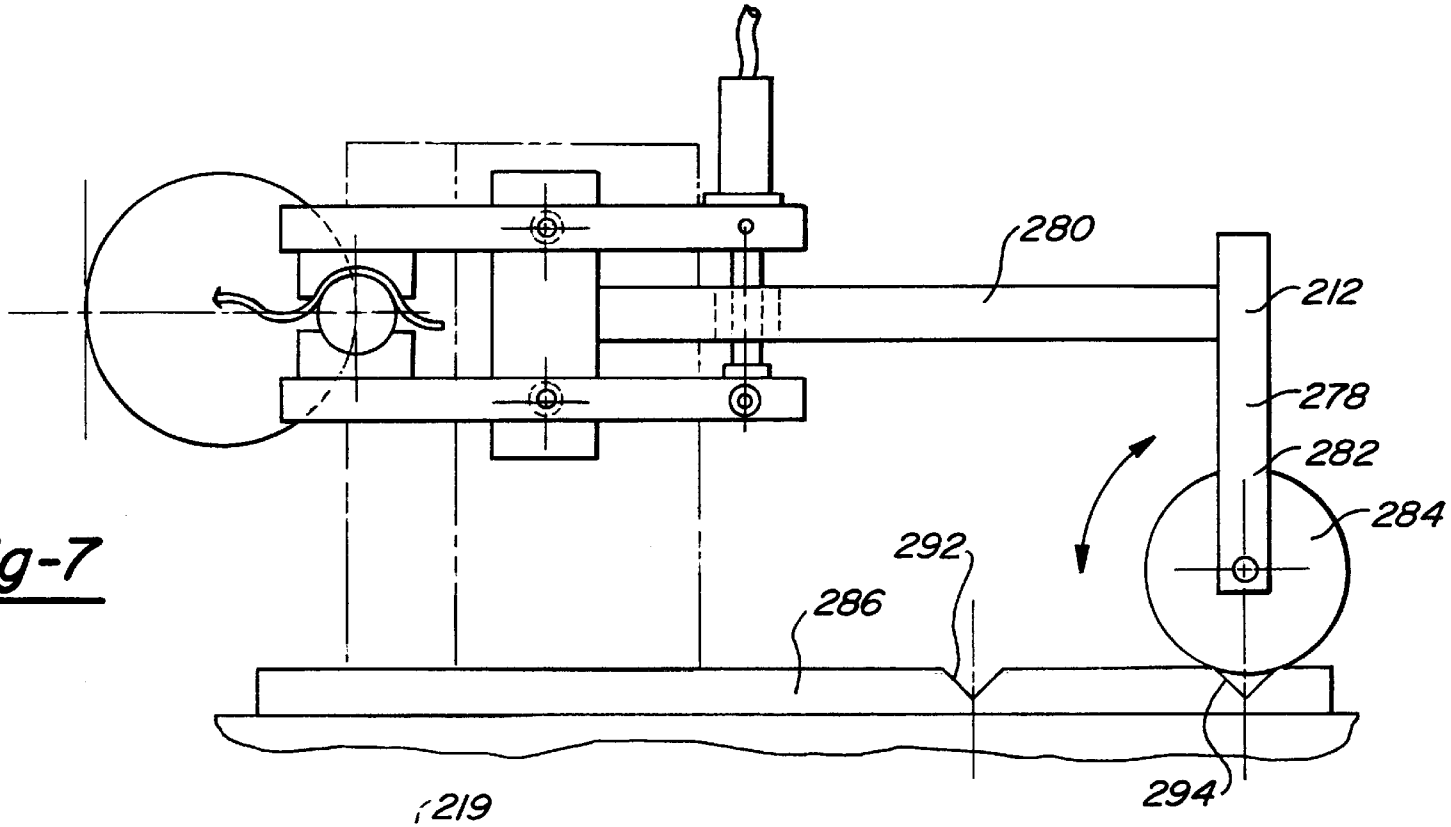
FIG. 7 is a side view of an alternative surface polishing tool of the present invention and a workpiece.
Figure 8:
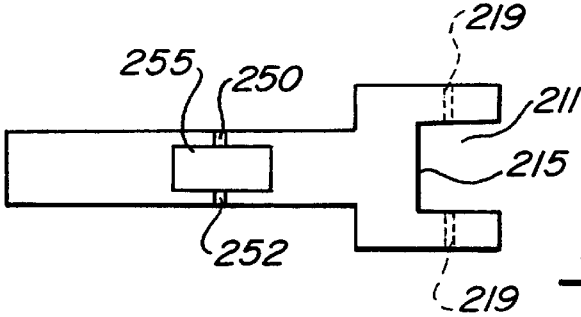
FIG. 8 is a top view of a polishing arm of an alternative embodiment of the present invention.

Referring now to FIGS. 6, 7 and 8, there is shown an alternative embodiment of the present invention. An alternative surface polishing tool is shown generally designated by reference numeral 210. Surface polishing tool 210 is shown affixed to polishing tool assembly 212. The surface polishing tool 210 includes first and second polishing arms 214 and 216 which are both pivotally connected to the polishing tool body 218. The polishing arms 214 and 216 are shown in FIG. 6 in a treatment position contacting the bearing or process surface 220 of an automotive cam shaft 222.

The polishing tool body 218 is shown having a pair of extending sections 254 and 256 which have respective throughbores 258 and 260 disposed thereon. Polishing tool body 218 is disposed within cavity 255 on first polishing arm 214 and within cavity 257 on second polishing arm 216. The throughbores 250 and 252 are located on first polishing arm 214 and extend through to cavity 255. Throughbore 258 of the polishing tool body 218 is of the same diameter as the throughbores 250 and 252 of the first polishing arm to allow pivot pin 236 to be located inside the coaxially aligned throughbores 250, 252 and 258. The throughbores located on the second polishing arm 216 extend into cavity 257 and are identically located as those throughbores on the first polishing arm 214. Throughbore 260 of the polishing tool body 218 is of the same diameter as the throughbores of the second polishing arm to allow pivot pin 238 to be located inside the coaxially aligned throughbores as described above with respect to the first polishing arm 214. The polishing arms 214 and 216 are thus pivotably connected to the polishing tool body 218.

Polishing arms 214 and 216 have first ends 224 and 226 adapted to be pivotably connected to body 218. The second ends 228 and 230 are constructed to accept various families of grinding means 231 depending on the workpiece and the extent of surface finishing required. Various grinding means 231 may be attached to the second ends 228 and 230 of the polishing arms 214 and 216 by any suitable fastening means. FIG. 6 shows one example of a grinding means 231, an abrasive-coated tape grinding system using tape back-up shoes 232 and coated abrasive tape 234. Common abrasive tape feed and take-up mechanisms are not shown, but are known in the art. Other grinding materials include honing stones using diamond, carborundum, garnet, cubic boron nitride and other like substances.

Referring now to FIG. 6 there is shown a pair of abrasive-coated tape back-up shoes 232 adapted to receive the bearing surface 220 of a workpiece such as cam shaft 222. Abrasive-coated tape 234 is shown contacting tape back-up shoes 232 to further illustrate the relative positions of back-up shoes 232, abrasive-coated tape 234 and bearing surface 220 during operation of the polishing assembly. Disposed on the first end 224 of the first polishing arm 214 is an actuating means 241 for moving the first and second polishing arms about the first and second pivot pins 236 and 238 respectively. The actuating means moves the first and second polishing arms 214 and 216 from a respective treatment enabling position adjacently spaced from the workpiece to a respective treatment position wherein the grinding means 231 engages the bearing surface 220 of the workpiece.

In the preferred embodiment of the present invention, the actuating means 241 is a fluid biasing cylinder 240. The fluid biasing cylinder 240 includes a stationary end 242 and a reciprocating end 244. The stationary end 242 of fluid biasing cylinder is disposed on the first end 224 of the first polishing arm 214. Referring to FIG. 8, there is shown first polishing arm 214 having a fork 215. Second polishing arm 216 identical to the first polishing arm 214. The fluid biasing cylinder 240 is connected to the first arm 214 by a pivot pin 217 shown in FIG. 6. Pivot pin 217 extends through bore 219 which extends through both sides of fork 215. A similar bore, not shown is included in the stationary end 242 of the fluid biasing cylinder 240. Fluid biasing cylinder is disposed inside the open cavity 211 of fork 215. The reciprocating end 244 of the fluid biasing cylinder 240 is pivotably connected to the first end 226 of the second polishing arm 216. The pivotal connection is made by a pivot pin 246 which extends through a bore 248 defined in the first end 226 of the second polishing arm 216. A similar bore, not shown is included in the reciprocating end 244 of the fluid biasing cylinder 240.

In this manner, when the reciprocating end 244 of the fluid biasing cylinder is forced out of the fluid biasing cylinder 240, the respective first ends 228 and 230 of the first and second polishing arms 214 and 216 are forced away from each other thereby moving the first and second polishing arms about first and second pivot pin 236 and 238 thereby and producing a grinding pressure at the surface grinding means 231 of each respective first and second polishing arms 214 and 216 when the polishing arms are in the treatment position.

Fluid biasing cylinder 240 is attached to a controller (not shown) which provides control commands to the fluid compressing means (not shown) for controlling the amount and duration of pressure required to activate the fluid biasing cylinder 240. In this manner, as the fluid biasing cylinder 240 is operated, the reciprocating end 244 of the cylinder moves and in turn move the first and second polishing arms 214 and 216 from a treatment enabling position (not shown) to a treatment position as shown in FIGS. 6 and 7.

FIGS. 6 and 7 show a polishing assembly 212 of the present invention having a surface polishing tool 210 which is pivotally and rollingly supported upon polishing assembly 212 by a rolling support assembly 278. Rolling support assembly 278 is comprised of an elongated support arm 280, a fork member 282 and a rolling wheel 284.

A track 286 is shown in FIGS. 6 and 7 and is affixed to sliding base 288. The track 286 includes detents 292 and 294 which assist in linearly positioning the surface polishing tool 210. Specifically, the track 286 is provided for the rolling wheel 284 to travel over and make contact with, and the detents 292 and 294 are designed to provide a means for locating the rolling wheel 284 in a stationary position exactly as discussed previously. This temporary stationary position is useful for manual operation of the polishing tool 210. The present invention includes provision of any number of detents allowing the track 286 to provide for many different predetermined stationary positions of the polishing tool 210. These positions are determined by the type and size of workpiece to be finished.

Referring to FIG. 6, rolling support assembly 278 operates as a universal support means for pivotably supporting the surface polishing tool 210 and further allowing for manual movements of the polishing tool in a direction toward the camshaft 222 and away from the camshaft 222. This movement or manual locating is important when microfinishing crank shaft pin surfaces. As shown in FIG. 7, a crank shaft 300 includes a plurality of cylindrical pin bearing surfaces 302 which must be correctly microfinished for correct operation as discussed previously.

Figures 9, 10:
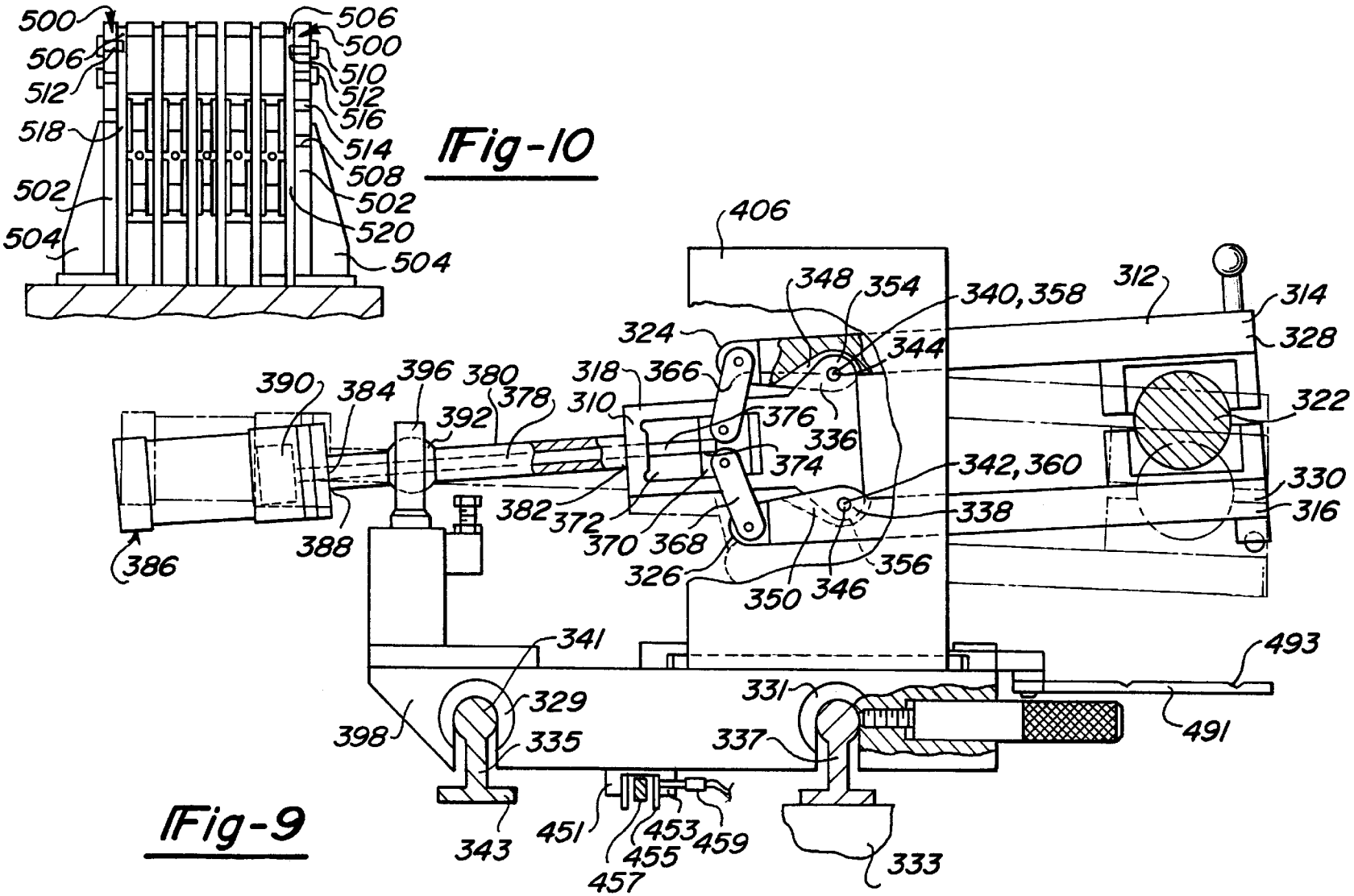
FIG. 9 is yet another alternative embodiment of the present invention.
FIG. 10 is a side view of alternative adjustable stabilizing plate of the present invention.

With reference to FIG. 9, there is shown yet another alternative embodiment of the present invention, a surface polishing tool is shown generally designated by reference numeral 310. Polishing tool 310 is incorporated in the polishing assembly designated by reference numeral 312. Polishing tool 310 is shown having a first polishing arm 314 and a second polishing arm 316 which are both pivotally connected to the polishing tool body 318. The polishing arms 314 and 316 are shown in FIG. 9 in a treatment position on the automotive crankshaft 322.

Polishing arms 314 and 316 have first ends 324 and 326 adapted to be pivotably connected to body 318 and second ends 328 and 330 which are constructed to accept various families of grinding means depending on the workpiece and the extent of surface finishing required. Various grinding means may be attached to the second ends 328 and 330 of the polishing arms 314 and 316 by any suitable fastening means. Any grinding means as discussed previously will operate with this embodiment of the present invention.

Disposed between first ends 324 and 326 and second ends 328 and 330 of top and bottom polishing arms 314 and 316 are identical pairs of connecting members 336 and 338 which extend from respective arms 314 and 316. Connecting members 336 and 338 have throughbores 340 and 342, respectively, which accept pivot pins 344 and 346, respectively. Polishing arms 314 and 316 have hollowed recesses 348 and 350 disposed between the pairs of connecting members 336 and 338.

Still referring to FIGS. 9, polishing tool body 318 is shown having a pair of extending sections 354 and 356 which have respective throughbores 358 and 360 disposed thereon. The connecting members of the polishing arms are adapted to cooperate with the extending sections of the tool body. Throughbores 340 and 342 are of the same diameter as the throughbores 358 and 360 of the polishing arms to allow pivot pins 344 and 346 to be located inside the throughbores and the polishing arm bores.

The polishing arms 314 and 316 are thus pivotably connected to the polishing tool body 318 by placing the connecting members 336 and 338 of polishing arms within the extending sections 354 and 356. Extending sections 354 and 356 have recesses 362 and 364 for receiving the connecting members of the polishing arms 314 and 316. Pivot pins 344 and 346 are press fit inside the throughbores and work as pivoting members for the polishing arms. The surface polishing tool 310 of the present invention is designed to operate with two polishing arms connected to the polishing tool body but it is contemplated that microfinishing may also be accomplished with just one polishing arm.

The second ends 328 and 330 of the polishing arms 314 and 316 are pivotally connected to two pairs of metal links 366 and 368, and 368. The pairs of metal links 366 and 368 are identical and are disposed on opposite sides of the second ends 328 and 330 of the polishing arms. The pairs of metal links 366 and 368 are connected at their other end to slide block 370. Slide block 370 is disposed within hollow track 372 defined within polishing tool body 318.

Hollow track 372 is configured to allow sliding engagement between slide block 370 and track 372. Slide block 370 has a threaded hole 374 for receiving and connecting to tie rod 376. Tie rod 376 extends within hollow chamber 378 of sleeve 380 which is attached at one end 382 to track 372.

The actuating end 384 of tie rod 376 is positioned in a fluid motor such as either a regulated hydraulic or regulated pneumatic cylinder, generally indicated as 386 which is attached to the other end 388 of the sleeve 380. This regulated cylinder 386 is operated by a manual control, not shown, to extend the actuating piston 390 of the regulated cylinder 386 to which the tie rod end 384 is connected. As the actuating piston 390 is reciprocated according to the manual operation of the regulated cylinder, the tie rod is reciprocated moving the slide block within track 372. Tie rod 376 and regulated cylinder 386 act in conjunction with slide block 370 as an actuating means for moving the arms to embrace the surface on the workpiece to be finished.

Still referring to FIG. 9, slide block 370 moves laterally, it forces the pairs of metal links 366 and 368 to move to a vertical position and thus force polishing arms 314 and 316 to pivot around pivot pins 344 and 346. This brings first ends 324 and 326 having a grinding means to bear upon the workpiece bearing surface.

Different regulated cylinders with different bores and different stroke lengths produce different finishing pressures on the machine component. The pneumatic regulated cylinder 386 shown in FIG. 9 has a one-and-one-half inch bore with a two inch stroke length. Using this size cylinder in cooperation with the predetermined pivot position of each polishing arm and the links, the finishing pressure at the grinding means position using approximately 60 psi of line pressure is approximately 200–300 pounds per square inch.

Compressive contact between the grinding means contained on the polishing arms 314 and 316 and the workpiece surface as the workpiece is being rotated about its longitudinal axis creates the microfinishing action that finishes the surface of the workpiece. FIG. 9 shows a polishing assembly of the present invention with one surface polishing tool 310 affixed. Surface polishing tool 310 is pivotally supported upon polishing assembly 312 by a spherical bearing 392 having an aperture 394 adapted to slidably receive sleeve 380. Spherical bearing 392 is journaled within housing 396 which is connected to base 398 of polishing assembly 312.

Sleeve 380 is journaled within aperture 394 of spherical bearing 392. Spherical bearing 392 and housing 396 act as a universal support means for pivotably supporting the surface polishing tool 310 and allows for movement of the polishing tool in any direction. Specifically, the use of spherical bearing 392 and housing 396 allow for vertical, pivotal movement of surface polishing tool 310. This vertical movement is important when microfinishing crank shaft pin surfaces.

For adequate microfinishing of pin bearing surfaces the entire polishing tool 310 must be movable with respect to the throw of the crank shaft pin bearings. This flexibility is necessary because the bearing surfaces of the pin bearings are positioned eccentrically with respect to the center of rotation of the crankshaft. As shown in FIG. 9, the polishing tool 10 can pivot vertically corresponding to the orbit of most crank shafts. The pivotal connection between the spherical bearing 392 and the sleeve 380 allows for surface polishing tool 310 to orbit with conventional pin bearing surfaces located on most crank shafts.

As shown in FIG. 9, a pair of stabilizing plates 406 are located directly adjacent the surface polishing tool 10. Stabilizing plates 406 stabilize the surface polishing tool 310 against lateral movement during the finishing operation. Stabilizing plates 406 are positioned adjacent the surface polishing tool 310 with a minimum running clearance between surface polishing tool 310 and the inner walls of the stabilizing plates as described previously. This minimum running clearance is achieved by locating the stabilizing plates adjacent the surface polishing tool to a point where sliding contact is made between the surface polishing tool and the stabilizing plates.

Referring still to FIG. 9, sliding base 398 includes a pair of guideways 329 and 331 which extend through the base from one side to the other. The support table 333 includes affixed thereon a pair of extending flanged support rails 335 and 337. The flanged support rails are configured to cooperatively mate and slidingly engage the respective guideways 329 and 331. The flanged support rail 337 and 339 shown in FIG. 9 includes a first portion 341 which is generally circular in cross section and a second portion 343 which is generally rectangular in cross section connected by another rectangular portion to form the final guideway cross sectional shape. In this manner, linear positioning of the sliding base 398 along the axis of rotation of the workpiece and in turn the polishing assembly 310 is accomplished. This guideway and flanged support rail system of the present invention is an improvement of previous designs which utilized an extending shaft and bearing system. The guideway 329 and flanged support rail 343 system provide increased weight support capacity and afford the ability for acceptance of larger polishing assemblies for larger finishing application while still affording ease of manual operation by a single operator.

Also shown in FIG. 9 is a caliper brake 451 or brake means for retaining the sliding base 398 in any position along the axis of the crankshaft. The caliper brake 451 includes a caliper 453 affixed to the underside of the sliding base 398. A pair of brake shoes 455 are located directly adjacent the caliper 453. An extending rail 457 is shown below sliding base 398. The extending rail 457 is affixed to the support table 333. A fluid biasing cylinder 459 is shown in FIG. 9 and is also affixed to the sliding base 398. The fluid biasing cylinder is designed to move one of the pair of brake shoes 455 into engagement with the rail 457 and retain the sliding base 398 is a stationary position during a finishing operation. A force of 400 pounds per square inch applied to the brake shoe 455 by the fluid biasing cylinder will sufficiently maintain the sliding base 398 in a stationary position during a finishing operation.

A polishing arm support brace 491 is also affixed to sliding base 398. The support brace 491 supports the second polishing arm 316 when the first and second polishing arms 316 and 314 are being transferred from the treatment position to the treatment enabling position and vice versa. The polishing arm support brace 491 may include a detent 493 for locating the polishing assembly in a predetermined position as discussed above. Polishing arm support brace 491 is useful in assisting the operator in manually moving larger polishing assemblies as some application such as large crankshaft applications require large polishing assembly that may be slightly difficult to move from the treatment position to the treatment enabling position and vice versa. In additions a wheel 489 is rollingly attached to the second polishing arm 316 to roll along the support brace 491. This also assists the operator in manually positioning the polishing tool in relation to the workpiece.

Referring now to FIGS. 10 there is shown an alternative stabilizing plate of the present invention. Adjustable stabilizing plates 500 include a pair of clamping plates 502 a pair of clamping fixtures 504. There is also shown a pair of wear plates 506 which are adjustably affixable to the respective clamping plates 502. More specifically, the clamping plates include a plurality of holes 508 designed to accept a plurality of correspondingly sized adjustment screws 510. The wear plates 506 include a plurality of tapped holes 512 which are coaxially aligned with the holes 508 on the clamping plates 502.

In addition, the stabilizing plates include a plurality of tapped holes 514. The tapped holes 514 are designed to accept a plurality of correspondingly sized set screws 516. In operation, to the adjust the stabilizing plates to a new or different polishing arm assembly, the polishing arm assembly is placed in between the wear plates 506 as shown in FIG. 10. The adjustment screws 510 are adjusted such that the polishing arms 314 and 316 make direct contact with the respective inner surfaces 518 and 520 of the wear plates. The set crews 516 are then tightened to lock the wear plates in the adjusted position. A light coating of lubrication is then provided to the inner surfaces 518 and 520 to assist in operation of the assembly. It is contemplated by the present invention that the adjustable stabilizing plates 506 are useable with all the embodiments of the present invention herein described.

While the best mode for carrying out the invention has been described in detail, those familiar with the art to which this invention relates will recognize various alternative designs and embodiments for practicing the invention as defined by the following claims.

What is claimed is:

1. A surface polishing tool for attachment to various power means for rotating a workpiece about an axis in a finishing process, said workpiece having at least one process surface, said surface polishing tool comprising:

a body adapted to be positioned adjacent said workpiece and having first and second pivot means for supporting a pair of spaced apart polishing arms;

a first polishing arm pivotable on said first pivot means, said first arm having a first end including a surface grinding means for finishing said process surface of said workpiece and a second end;

a second polishing arm pivotable on said second pivot means, said second arm having a first end including a surface grinding means for finishing said process surface of said workpiece and a second end;

an actuating means for moving the first and second polishing arms about said first and second pivot means from a respective treatment enabling position adjacently spaced from said workpiece to a respective treatment position wherein said surface grinding means engages said workpiece, said actuating means having a stationary end and a reciprocating end, said stationary end of said actuating means connected to the second end of the first polishing arm and said reciprocating end of said actuating means connected to the second end of the second polishing arm, whereby said actuating means forces said respective second ends of the first and second polishing arms away from each other thereby moving the first and second polishing arms about said first and second pivot means and producing a grinding pressure at said surface grinding means of each respective first and second polishing arms when said polishing arms are in said treatment position;

a rolling support assembly for pivotably supporting and horizontally transferring said surface polishing tool in a first direction toward said workpiece and in a second opposite direction away from said workpiece thereby affording manual movement of the first and second polishing arms to assist in locating the first and second polishing arms in said treatment position; and a sliding base affixable to said body and manually moveable linearly with respect to said workpiece along and adjacent to said axis thereby allowing said polishing arms to be located with respect to said process surface on said workpiece and allowing said first and second polishing arms to be manually oscillated along a predetermined length of the process surface during said finishing process.

2. The surface polishing tool of claim 1 wherein said rolling support assembly comprises:

an elongated support arm having a first end and a second end, said first end affixed to said body;

a fork member connected to said second end of said elongated support arm;

a rolling wheel member attached to said fork member; and a track for supporting said wheel member, said track defining at least one detent for retaining said wheel member in a stationary position.

3. The surface polishing tool of claim 1 wherein said actuating means comprises a fluid biasing cylinder.

4. The surface polishing tool of claim 1 wherein said actuating means comprises a pair of fluid biasing cylinders, a first of one of said pair of fluid biasing cylinders disposed on one side of said body and a second of one of said pair of fluid biasing cylinders disposed on the opposite side of said body.

5. The surface polishing tool of claim 1 further comprising a pair of rigid stabilizing plates mounted directly to the base independent of said body said plates disposed directly adjacent to and on opposite sides of said rolling support assembly, said plates disposed in abutting engagement with said rolling support assembly but sufficiently spaced part a minimum running clearance to allow movement of the rolling support assembly in a vertical plane substantially perpendicular said axis.

6. A surface polishing tool as in claim 1 further comprising a pair of adjustable stabilizing plates mounted directly to the base independent of said body, a pair of wear plates disposed directly adjacent to and on opposite sides of said first and second polishing arms, said wear plates disposed in abutting engagement with said first and second polishing arms but sufficiently spaced part a minimum running clearance to allow movement of the first and second polishing arms in a vertical plane substantially perpendicular to said axis wherein said wear plates are adjustably affixable to said respective adjustable stabilizing plates by a first set of adjustment fasteners for adjustably affixing said wear plates to said stabilizing plates and by a second set of fasteners for locking said wear plates in an adjusted position relative to said stabilizing plates.

7. A surface polishing tool as in claim 1 further comprising a polishing arm support brace affixed to said sliding base for supporting said second polishing arm when said first and second polishing arms are linearly transferred.

8. A surface polishing tool as in claim 1 further comprising a combination surface grinding means including a back-up shoe having a first contact surface cooperatively shaped to finish a first specific process surface of a workpiece and a second contact surface cooperatively shaped to finish a second specific process surface of a workpiece.

9. A surface polishing machine for polishing a workpiece having at least one process surface, said surface polishing machine comprising:

a power means for rotating a workpiece about an axis in a finishing process;

a body adapted to be positioned adjacent said workpiece and having first and second pivot means spaced apart from each other;

a first polishing arm pivotable on said first pivot means, said first arm having a first end adapted to receive a combination surface grinding means for finishing said process surface of said workpiece and a second end, said combination surface grinding means including a back-up shoe member having a first contact surface cooperatively shaped to finish said a first process surface of said workpiece and a second contact surface cooperatively shaped to finish a second process surface of workpiece contact said first and second contact surfaces are of different sizes;

a second polishing arm pivotable on said second pivot means, said second arm having a first end adapted to receive a combination surface grinding means for finishing said process surface of workpiece and a second end; said combination surface grinding means including a back-up shoe member having a first contact surface cooperatively shaped to finish a first process surface of workpiece and a second contact surface cooperatively shaped to finish a second process surface of workpiece wherein said first and second contact surfaces are of different sizes;

an actuating means for moving the first and second polishing arms about said first and second pivot means from a respective treatment enabling position adjacently spaced from said workpiece to a respective treatment position wherein said surface grinding means engages said workpiece, said actuating means having a stationary end and a reciprocating end, said stationary end of said actuating means connected to the first end of the first polishing arm and said reciprocating end of said actuating means connected to the first end of the second polishing arm, whereby said actuating means forces said respective first ends of the first and second polishing arms away from each other thereby producing a grinding pressure at said surface grinding means of each respective first and second polishing arms when said polishing arms are in said treatment position;

a rolling support assembly for pivotably supporting and horizontally transferring said surface polishing tool in a first direction toward said workpiece and in a second opposite direction away from said workpiece thereby affording manual movement of the first and second polishing arms to assist in locating the first and second polishing arms in said treatment position; and a sliding base affixable to said body and manually moveable linearly with respect to said workpiece along and adjacent to said axis thereby allowing said polishing arms to be located with respect to said process surface on said workpiece and allowing said first and second polishing arms to be manually oscillated along a predetermined length of the process surface during said finishing process.

10. A surface polishing machine as in claim 9 further comprising:

a pair of adjustable stabilizing plates mounted directly to the base independent of said body, a pair of wear plates disposed directly adjacent to and on opposite sides of said first and second polishing arms, said wear plates disposed in abutting engagement with said first and second polishing arms but sufficiently spaced part a minimum running clearance to allow movement of the first and second polishing arms in a vertical plane substantially perpendicular to said axis wherein said wear plates are adjustably affixable to said respective adjustable stabilizing plates by a first set of adjustment fasteners for adjustably affixing said wear plates to said stabilizing plates and by a second set of fasteners for locking said wear plates in an adjusted position relative to said stabilizing plates.

11. The surface polishing machine as in claim 9 further comprising a pair of stabilizing plates adjustably affixable to the base adjacent to and on opposite sides of the rolling support member, said clamps sufficiently spaced apart to restrict the rolling support member to movement in a plane substantially perpendicular to said axis.

12. A surface polishing tool as in claim 9 further comprising a polishing arm support brace affixed to said sliding base for supporting said second polishing arm when said first and second polishing arms are linearly transferred.

13. A surface polishing tool as in claim 9 further comprising a combination surface grinding means including a back-up shoe having a first contact surface cooperatively shaped to finish a first specific process surface of a workpiece and a second contact surface cooperatively shaped to finish a second specific process surface of a workpiece.

14. A surface polishing machine for polishing a workpiece having at least one process surface, said surface polishing machine comprising:

a power means for rotating a workpiece about an axis in a finishing process;

a body adapted to be positioned adjacent said workpiece and having first and second pivot means spaced apart from each other;

a first polishing arm pivotable on said first pivot means, said first arm having a first end adapted to receive a surface grinding means for finishing said workpiece and a second end;

a second polishing arm pivotable on said second pivot means, said second arm having a first end adapted to receive a surface grinding means for finishing said workpiece and a second end;

an actuating means connected to the respective second ends of the first and second polishing arms for moving the arms about said first and second pivot means from respective treatment enabling positions adjacently spaced from said workpiece to respective treatment positions wherein said surface grinding means engages said workpiece, whereby said actuating means forces said respective second ends of the first and second polishing arms away from each other thereby producing a grinding pressure at said surface grinding means of each respective first and second polishing arms;

a rolling support member for pivotably supporting and horizontally transferring said surface polishing tool to predetermined positions polishing positions;

a base for supporting said rolling support member, said base being movable with respect to said workpiece along and adjacent to said axis, said base including at least one guideway extending, throughbore said base; and a support table for supporting said power means and said base, said support table including at least one flanged support rail configured to cooperatively mate and slidingly engage with said at least one guideway to provide linear positioning of said base.

15. A surface polishing machine as in claim 14 wherein said support rail has a generally "I" shaped cross section.

16. A surface polishing machine as in claim 14 wherein said support rail has a first portion which is generally circular in cross section and a second portion which is generally rectangular in cross section.

17. The surface polishing machine of claim 14 wherein said rolling support assembly comprises:

an elongated support arm connected to said body;

a fork member connected to said support arm;

a wheel member attached to said fork member; and a track for supporting said wheel member, said track defining at least one detent for retaining said wheel member in a stationary position.

18. The surface polishing machine of claim 14 wherein said actuating means comprises a fluid biasing cylinder.

19. The surface polishing machine of claim 14 wherein said actuating means comprises a pair of fluid biasing cylinders, a first of said pair of fluid biasing cylinders disposed on one side of said body and a second of said pair of fluid biasing cylinders disposed on the opposite side of said body.

20. A surface polishing machine of claim 14 further comprising a polishing arm support brace affixed to said sliding base for supporting said second polishing arm when said first and second polishing arms are linearly transferred.

21. The surface polishing machine of claim 17 wherein said track includes a first detent corresponding to a non-engaged position of said polishing arms with said workpiece and a second detent corresponding to an engaged position of said polishing arms with said workpiece.

22. A surface polishing tool for attachment to various power means for rotating a workpiece about an axis in a finishing process, said workpiece having at least one process surface, said surface polishing tool comprising:

a body adapted to be positioned adjacent said workpiece and having first and second pivot means for supporting a pair of spaced apart polishing arms;

a first polishing arm pivotable on said first pivot means, said first arm having a first end including a surface grinding means for finishing said process surface of said workpiece and a second end;

a second polishing arm pivotable on said second pivot means, said second arm having a first end including a surface grinding means for finishing said process surface of said workpiece and a second end;

an actuating means for moving the first and second polishing arms about said first and second pivot means from a respective treatment enabling position adjacently spaced from said workpiece to a respective treatment position wherein said surface grinding means engages said workpiece, said actuating means having a stationary end and a reciprocating end, said stationary end of said actuating means disposed on the second end of the first polishing arm and said reciprocating end of said actuating means connected to the second end of the second polishing arm, said second end of said first polishing arm defining a cavity wherein said reciprocating end of said actuating means is movable through, whereby said actuating means forces said respective second ends of the first and second polishing arms away from each other thereby moving the first and second polishing arms about said first and second pivot means and producing a grinding pressure at said surface grinding means of each respective first and second polishing arms when said polishing arms are in said treatment position;

a rolling support assembly for pivotably supporting and horizontally transferring said surface polishing tool in a first direction toward said workpiece and in a second opposite direction away from said workpiece thereby affording manual movement of the first and second polishing arms to assist in locating the first and second polishing arms in said treatment position; and a sliding base affixable to said body and manually moveable linearly with respect to said workpiece along and adjacent to said axis thereby allowing said polishing arms to be located with respect to said process surface on said workpiece and allowing said first and second polishing arms to be manually oscillated along a predetermined length of the process surface during said finishing process.

23. The surface polishing tool of claim 22 wherein said rolling support assembly comprises:

an elongated support arm connected to said body, said support arm including an elongate guideway for accepting said reciprocating end of said actuating means;

a fork member connected to said support arm;

a wheel member attached to said fork member; and a track for supporting said wheel member, said track defining at least one detent for retaining said wheel member in a stationary position.

24. A surface polishing tool as in claim 22 further comprising a polishing arm support brace affixed to said sliding base for supporting said second polishing arm when said first and second polishing arms are linearly transferred.

25. A surface polishing tool for attachment to various power means for rotating a workpiece about an axis in a finishing process, said workpiece having at least one process surface, said surface polishing tool comprising:

a body adapted to be positioned adjacent said workpiece and having first and second pivot means for supporting a pair of spaced apart polishing arms;

a first polishing arm pivotable on said first pivot means, said first arm having a first end including a surface grinding means for finishing said process surface of said workpiece and a second end;

a second polishing arm pivotable on said second pivot means, said second arm having a first end including a surface grinding means for finishing said process surface of said workpiece and a second end;

an actuating means for moving the first and second polishing arms about said first and second pivot means from a respective treatment enabling position adjacently spaced from said workpiece to a respective treatment position wherein said surface grinding means engages said workpiece, said actuating means having a stationary end and a reciprocating end, said stationary end of said actuating means connected to the second end of the first polishing arm and said reciprocating end of said actuating means connected to the second end of the second polishing arm, whereby said actuating means forces said respective second ends of the first and second polishing arms away from each other thereby moving the first and second polishing arms about said first and second pivot means and producing a grinding pressure at said surface grinding means of each respective first and second polishing arms when said polishing arms are in said treatment position;

a rolling support assembly for pivotably supporting and horizontally transferring said surface polishing tool in a first direction toward said workpiece and in a second opposite direction away from said workpiece thereby affording manual movement of the first and second polishing arms to assist in locating the first and second polishing arms in said treatment position;

a sliding base affixable to said body and manually moveable linearly with respect to said workpiece along and adjacent to said axis thereby allowing said polishing arms to be located with respect to said process surface on said workpiece and allowing said first and second polishing arms to be manually oscillated along a predetermined length of the process surface during said finishing process; and a caliper brake means for retaining said sliding base in any position along said axis.

26. The surface polishing tool of claim 25 wherein said caliper brake means comprises:

a caliper affixed to said sliding base;

at least one brake shoe located directly adjacent said caliper;

an extending rail; and a fluid biasing cylinder for moving said brake shoe into engagement with said rail and retaining said sliding base.

27. A surface polishing tool for attachment to various power means for rotating a workpiece about an axis in a finishing process, said workpiece having at least one process surface, said surface polishing tool comprising:

a body adapted to be positioned adjacent said workpiece and having first and second pivot means for supporting a pair of spaced apart polishing arms;

a first polishing arm pivotable on said first pivot means, said first arm having a first end including a surface grinding means for finishing said process surface of said workpiece and a second end;

a second polishing arm pivotable on said second pivot means, said second arm having a first end including a surface grinding means for finishing said process surface of said workpiece and a second end;

an actuating means for moving the first and second polishing arms about said first and second pivot means from a respective treatment enabling position adjacently spaced from said workpiece to a respective treatment position wherein said surface grinding means engages said workpiece, said actuating means having a stationary end and a reciprocating end, said stationary end of said actuating means connected to the second end of the first polishing arm and said reciprocating end of said actuating means connected to the second end of the second polishing arm, whereby said actuating means forces said respective second ends of the first and second polishing arms away from each other thereby moving the first and second polishing arms about said first and second pivot means and producing a grinding pressure at said surface grinding means of each respective first and second polishing arms when said polishing arms are in said treatment position;

a rolling support assembly for pivotably supporting and horizontally transferring said surface polishing tool in a first direction toward said workpiece and in a second opposite direction away from said workpiece thereby affording manual movement of the first and second polishing arms to assist in locating the first and second polishing arms in said treatment position;

a sliding base affixable to said body and manually moveable linearly with respect to said workpiece along and adjacent to said axis thereby allowing said polishing arms to be located with respect to said process surface on said workpiece and allowing said first and second polishing arms to be manually oscillated along a predetermined length of the process surface during said finishing process; and a polishing arm support brace for supporting said second polishing arm when said first and second polishing arms are being transferred between the treatment position and the treatment enabling position, said support brace being affixed to said sliding base.

* * * * *